US008648729B2

(12) United States Patent
Gado et al.

(10) Patent No.: US 8,648,729 B2
(45) **Date of Patent: *Feb. 11, 2014**

(54) REFRIGERANT CHARGE LEVEL DETECTION

(71) Applicant: Emerson Electric Co., St. Louis, MO (US)

(72) Inventors: Amr E. Gado, Creve Coeur, MO (US); Thomas J. Fredricks, McKinney, TX (US); Thomas B. Lorenz, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/917,781

(22) Filed: Jun. 14, 2013

(65) Prior Publication Data

US 2013/0285822 A1 Oct. 31, 2013

Related U.S. Application Data

(63) Continuation-in-part of application No. 13/101,516, filed on May 5, 2011, now Pat. No. 8,466,798.

(51) Int. Cl.
*G08B 21/00* (2006.01)

(52) U.S. Cl.
USPC ..... 340/614; 340/603; 340/612

(58) Field of Classification Search
USPC ..... 340/614, 612
See application file for complete search history.

(56) References Cited

U.S. PATENT DOCUMENTS

| | | | | |
|---|---|---|---|---|
| 4,677,830 | A | 7/1987 | Sumikawa et al. | |
| 5,392,612 | A * | 2/1995 | Alsenz | 62/115 |
| 5,987,903 | A | 11/1999 | Bathla | |
| 6,571,566 | B1 | 6/2003 | Temple et al. | |

(Continued)

FOREIGN PATENT DOCUMENTS

| | | |
|---|---|---|
| JP | 08-014717 | 1/1996 |
| WO | WO2008/079108 | 7/2008 |
| WO | WO2012/151035 | 11/2012 |

OTHER PUBLICATIONS

International Search Report and Written Opinion for PCT International Application No. PCT/US2012/033506 (published Nov. 8, 2012 as WO2012/151035) dated Dec. 12, 2012; 10 pages. The instant application is a continuation-in-part of U.S. Appl. No. 13/101,516 which PCT/US2012/033506 claims priority to.

*Primary Examiner* — Kerri McNally
(74) *Attorney, Agent, or Firm* — Harness, Dickey & Pierce, P.L.C.

(57) ABSTRACT

An exemplary embodiment of a system includes first and second sensors. The first sensor is operable to provide an output indicative of a sensed refrigerant liquid temperature of a liquid refrigerant line that is within or extending from an outlet of a condenser coil of an air conditioner or heat pump unit. The second sensor is operable to provide an output indicative of a sensed refrigerant liquid pressure in the liquid refrigerant line. A controller is configured to determine at least one target pressure value from the output indicative of the sensed refrigerant liquid temperature of the liquid refrigerant line. The controller is configured to determine if the level of refrigerant charge is at, above, or below an acceptable level based on a comparison of the output indicative of sensed refrigerant liquid pressure to the at least one target pressure value.

19 Claims, 4 Drawing Sheets

(56) References Cited

U.S. PATENT DOCUMENTS

| | | | | |
|---|---|---|---|---|
| 6,679,072 | B2 * | 1/2004 | Pham et al. | 62/126 |
| 6,758,051 | B2 | 7/2004 | Jayanth et al. | |
| 6,981,384 | B2 * | 1/2006 | Dobmeier et al. | 62/149 |
| 7,343,750 | B2 | 3/2008 | Lifson et al. | |
| 7,380,404 | B2 * | 6/2008 | Kang et al. | 62/127 |
| 7,386,985 | B2 | 6/2008 | Concha et al. | |
| 7,469,546 | B2 * | 12/2008 | Kates | 62/129 |
| 7,472,557 | B2 | 1/2009 | Kang et al. | |
| 7,500,368 | B2 | 3/2009 | Mowris | |
| 7,552,596 | B2 | 6/2009 | Galante et al. | |
| 7,610,765 | B2 | 11/2009 | Kang et al. | |
| 7,631,508 | B2 | 12/2009 | Braun et al. | |
| 8,466,798 | B2 * | 6/2013 | Gado et al. | 340/614 |
| 2006/0145885 | A1 | 7/2006 | Goulis et al. | |
| 2010/0089076 | A1 | 4/2010 | Schuster et al. | |
| 2012/0280816 | A1 | 11/2012 | Gado et al. | |

* cited by examiner

REFRIGERANT CHARGE LEVEL DETECTION

CROSS-REFERENCE TO RELATED APPLICATION

This application is a continuation-in-part of U.S. patent application Ser. No. 13/101,516 filed May 5, 2011, which will issue Jun. 18, 2013 as U.S. Pat. No. 8,466,798. The entire disclosure of the above application is incorporated herein by reference.

FIELD

The present disclosure relates to climate control systems for providing conditioned air to a space, and more specifically to refrigerant charge level of a cooling system for a space.

BACKGROUND

This section provides background information related to the present disclosure which is not necessarily prior art.

Refrigeration systems generally require a significant amount of energy to operate, and represent a significant portion of energy costs. As a result, it is in the consumers' best interest to closely monitor the performance of their air conditioner or heat pump systems to maximize their efficiency, thereby reducing operational costs. For example, the refrigerant charge level in the air conditioner or heat pump may become low due to losses during operation, which hinders the efficiency and ability of the system to provide adequate cooling. However, monitoring system performance typically involves tedious and time-consuming tasks utilizing temperature measuring equipment that may require expertise to accurately analyze refrigerant temperature data and relate that data to system performance and efficiency.

SUMMARY

This section provides a general summary of the disclosure, and is not a comprehensive disclosure of its full scope or all of its features.

Various embodiments of a system are provided for monitoring a refrigerant charge level in an air conditioner or heat pump. An exemplary embodiment of a system includes first and second sensors. The first sensor is operable to provide an output indicative of a sensed refrigerant liquid temperature of a liquid refrigerant line that is within or extending from an outlet of a condenser coil of an air conditioner or heat pump unit. The second sensor is operable to provide an output indicative of a sensed refrigerant liquid pressure in the liquid refrigerant line. A controller is configured to determine at least one target pressure value from the output indicative of the sensed refrigerant liquid temperature of the liquid refrigerant line. The controller is configured to determine if the level of refrigerant charge is at, above, or below an acceptable level based on a comparison of the output indicative of sensed refrigerant liquid pressure to the at least one target pressure value.

According to other aspects of the present disclosure, there are exemplary embodiments of methods for monitoring refrigerant charge level in an air conditioner or heat pump unit. In an exemplary embodiment, there is a method for monitoring refrigerant charge. This method includes sensing and providing a first output indicative of a sensed refrigerant liquid temperature of a liquid refrigerant line that is within or extending from an outlet of a condenser coil of an air conditioner or heat pump unit. This method also includes sensing and providing a second output indicative of a sensed refrigerant liquid pressure in the liquid refrigerant line. The method further includes determining at least one target pressure value from the output indicative of the sensed refrigerant liquid temperature of the liquid refrigerant line, and determining if the level of refrigerant charge is at, above, or below an acceptable level based on a comparison of the output indicative of sensed refrigerant liquid pressure to the at least one target pressure value.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

According to one aspect of the present disclosure, various embodiments of a system are provided for monitoring a refrigerant charge level in an air conditioner or heat pump. An exemplary embodiment of a system includes first and second sensors. The first sensor is operable to provide an output indicative of a sensed refrigerant liquid temperature of a liquid refrigerant line that is within or extending from an outlet of a condenser coil of an air conditioner or heat pump unit. The second sensor is operable to provide an output indicative of a sensed refrigerant liquid pressure in the liquid refrigerant line. A controller is configured to determine at least one target pressure value from the output indicative of the sensed refrigerant liquid temperature of the liquid refrigerant line. The controller is configured to determine if the level of refrigerant charge is at, above, or below an acceptable level based on a comparison of the output indicative of sensed refrigerant liquid pressure to the at least one target pressure value. The system may also include a display that displays an indication of whether the level of refrigerant charge is at, above, or below an acceptable level.

According to other aspects of the present disclosure, there are exemplary embodiments of methods for monitoring refrigerant charge level in an air conditioner or heat pump unit. In an exemplary embodiment, there is a method for monitoring refrigerant charge. This method includes sensing and providing a first output indicative of a sensed refrigerant liquid temperature of a liquid refrigerant line that is within or extending from an outlet of a condenser coil of an air conditioner or heat pump unit. This method also includes sensing and providing a second output indicative of a sensed refrigerant liquid pressure in the liquid refrigerant line. The method further includes determining at least one target pressure value from the output indicative of the sensed refrigerant liquid temperature of the liquid refrigerant line, and determining if the level of refrigerant charge is at, above, or below an acceptable level based on a comparison of the output indicative of sensed refrigerant liquid pressure to the at least one target pressure value. The method may also include displaying an indication of whether the level of refrigerant charge is at, above, or below an acceptable level, as explained herein.

Figure 1:
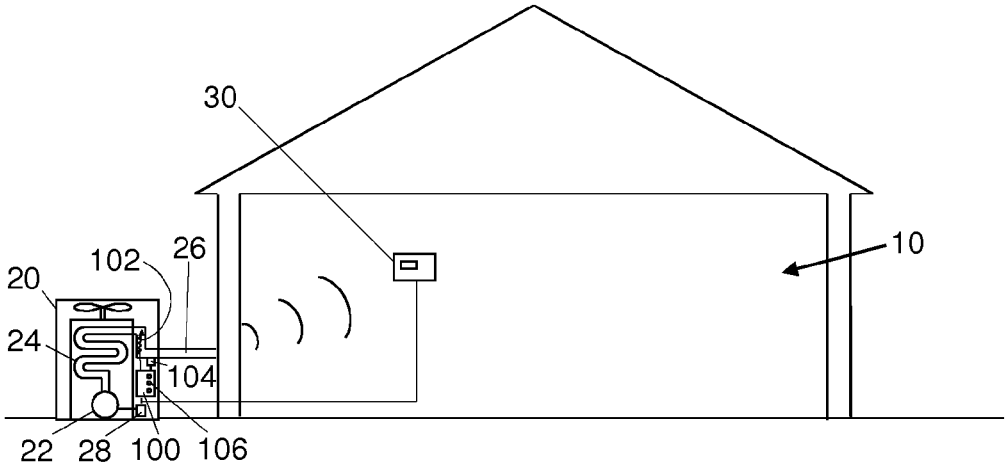
FIG. 1 shows an air conditioning or heat pump unit and one embodiment of a system having a controller for monitoring refrigerant charge.

Referring to FIG. 1, a residential climate control system for a space 10 is shown that includes an outdoor condenser unit of an air conditioner or heat pump 20 having a compressor 22 and a condenser coil 24. The air conditioner or heat pump 20 may comprise a switch or contactor 28 that switches alternating current to activate the compressor 22 of the air conditioner or heat pump 20, where the contactor 28 activates the compressor 22 in response to an activation signal from a thermostat 30. The thermostat 30 senses temperature within the space 10 and responsively sends an activation signal to initiate operation of at least the compressor 22 of the air conditioner or heat pump 20.

According to one aspect of the present disclosure, a system for monitoring refrigerant charge level is provided. The system includes a first sensor 102 that provides an output indicative of a sensed refrigerant liquid temperature of a liquid refrigerant line 26 that is within or extending from an outlet of a condenser coil 24 of the air conditioner or heat pump 20. At exit of the condenser, the refrigerant will be liquid after having been condensed from vapor at the inlet. Accordingly, the first sensor 102 is operable for sensing refrigerant liquid temperature of the liquid line 26 at the exit or outlet of the condenser coil 24. As the refrigerant is liquid not vapor at the exit or outlet of the condenser, the first sensor 102 is thus not sensing refrigerant vapor temperature.

The system further includes a second sensor 104 that provides an output indicative of a sensed refrigerant liquid pressure in the liquid refrigerant line 26 that is within or extending from the outlet of condenser coil 24. Again, the refrigerant will be liquid at the exit of the condenser after having been condensed from vapor at the inlet. Accordingly, the second sensor 104 is operable for sensing refrigerant liquid pressure of the liquid line 26 at the exit or outlet of the condenser coil 24. As the refrigerant is liquid not vapor at the exit or outlet of the condenser, the second sensor 104 is thus not sensing refrigerant vapor pressure.

The first and second sensors 102, 104 are operable for sensing temperature and pressure, respectively, of the liquid line 26 at the exit of the condenser. By way of background, a liquid line may be generally considered to be the line connected to an outlet of a condenser to a pressure reduction device, e.g., a throttle or orifice at the entry to an evaporator.

With continued reference to FIG. 1, the system further includes a controller 100 that is configured to determine at least one target pressure value from the output of the first sensor 102 that is indicative of the sensed refrigerant liquid temperature of the liquid refrigerant line 26 within or extending from the outlet of the condenser coil 24. The controller 100 is configured to compare the output of the second sensor 104 that is indicative of sensed refrigerant liquid pressure in the liquid refrigerant line 26 to the at least one target pressure value. The controller 100 is further configured to determine if the level of refrigerant charge is at, above, or below an acceptable level based on the comparison of the output indicative of sensed refrigerant liquid pressure to the at least one target pressure value.

The controller 100 includes or is in communication with a display 106 that displays an indication of whether the level of refrigerant charge is at, above, or below an acceptable level. The system may be in the form of a monitoring control having a controller 100 in communication with the first sensor 102, second sensor 104, and display 106. The system may alternatively, for example, have a controller 100 associated with a defrost control. The controller 100 may also be incorporated into a unitary control that is configured to connect a power source to activate at least a compressor 22 of an air conditioner or heat pump 20, as explained herein.

Figure 2:
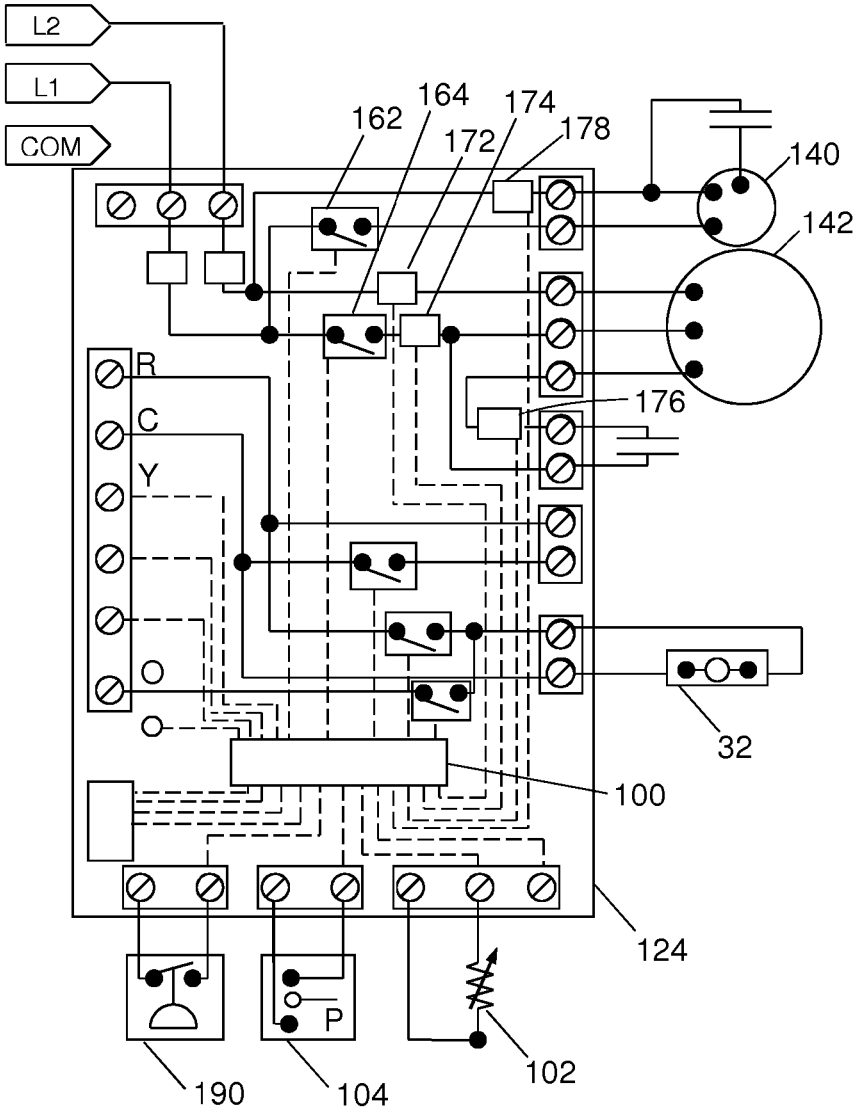
FIG. 2 shows a schematic diagram of a unitary control for an outdoor condenser unit of an air conditioner or heat pump in which the controller may be implemented, in accordance with the principles of the present disclosure.

Referring to FIG. 2, a schematic is shown of a unitary control 124 for controlling activation of at least the compressor 22 of the air conditioner or heat pump 20 shown in FIG. 1. The unitary control 124 may be powered via a 24 volt alternating current power source connected at R and C, which may supply a half wave regulated 5 volt power supply (not shown) comprising a diode in series with a transistor and a regulating capacitor and zener diode for gating the transistor. The power supply may also be a small transformer and zener diode circuit. The unitary control 124 preferably comprises a controller 100, which may be a microprocessor, for example. The unitary control 124 further includes a plurality of switching means 162, 164 for controlling the switching of line voltage (L1, L2) to a motor 142 (for the compressor 22 shown in FIG. 1) and a motor fan 140 (for the condenser fan shown in FIG. 1). The unitary control 124 further includes switching means for switching the reversing valve 32 between a heat mode and a cool mode, depending on the input signal at terminal 'O' from the thermostat 30. The switching means preferably comprise relays such as an A20500P2 relay manufactured by American Zettler. The unitary control 124 may include current sensors 172, 174, and 176 for sensing the current level in the start winding and run winding of the motor 142 (for the compressor 22 shown in FIG. 1), and a sensor 178 for sensing the current in the motor fan 140 (for the condenser fan shown in FIG. 1). Other sensors may include a first sensor 102 that provides an output indicative of a sensed refrigerant liquid temperature of a liquid refrigerant line 26 (in FIG. 1) within or extending from an outlet of the condenser coil 24 (in FIG. 1), and a second sensor 104 that provides an output indicative of a sensed refrigerant liquid pressure in the liquid refrigerant line 26 (in FIG. 1). Alternatively, the unitary control 124 may include a pressure switch 190. The condenser fan motor relay 162 and at least one compressor motor relay 164 are preferably controlled by a controller 100 of the unitary control 124, as explained herein.

The unitary control 124 includes a controller 100, which may be a 28 pin PIC16F microprocessor manufactured by Microchip, for example, which includes a plurality of Analog to Digital data inputs for receiving information from various inputs, such as the first sensor 102 and second sensor 104 for respectively sensing temperature and pressure for a liquid refrigerant line within or extending from a condenser coil 24 as shown in FIG. 1. One particular device in which the various embodiments of a controller 100 may be implemented is the 49H20 Unitary Control manufactured by White-Rodgers, a Division of Emerson Electric Co., which is configured to control activation of at least a compressor 22 of an air conditioner or heat pump 20, as shown in FIG. 1. The controller 100 is responsive to a signal at a "Y" terminal (from a thermostat 30 in FIG. 1) so as to detect a signal for activating the air conditioner or heat pump 20. The controller 100 may be configured to determine at least one target pressure value from the output of the first sensor 102 that is indicative of the sensed temperature of the liquid refrigerant line 26, and to compare the sensed pressure from second sensor 104 to the at least one target pressure value to determine if the level of refrigerant charge is at, above, or below an acceptable level. Accordingly, the controller 100 may be a processor of a unitary control 124 for controlling operation of at least a compressor 22.

In the above embodiment, the controller 100 in FIG. 1 is configured to determine at least one target pressure value from the output of the first sensor 102 that is indicative of the sensed refrigerant liquid temperature of the liquid refrigerant line 26. Specifically, the controller 100 is configured to determine a target pressure value by converting at least the sensed refrigerant liquid temperature of the liquid refrigerant line 26 into a corresponding pressure value based on a temperature-pressure relationship for the refrigerant. The controller 100 is ideally configured to determine a plurality of target pressure values, preferably for establishing a range defined by at least two target pressure values representative of a refrigerant level that is within an acceptable range, and more preferably for establishing a range defined by at least two target pressure values representing a level below an acceptable level, and a range defined by at least two target pressure values representing a level above an acceptable level. Such determination of target pressure values representative of an acceptable refrigerant level is explained herein.

In an air conditioner or heat pump 20, the level of resulting high side pressure of the refrigerant is dependent on operation of the compressor 22 and other factors, which may include ambient temperature, compressor suction pressure and refrigerant level. Accordingly, the refrigerant exiting the compressor 22 may be at a given pressure level when it enters the condenser coil 24, where the refrigerant cools to a saturation temperature at which the refrigerant transitions from a vapor state to a liquid state. Thus, refrigerant leaving the outlet of the condenser coil 24 is in a liquid state.

Based on a known temperature-pressure curve relationship of saturation temperature—saturation pressure for given refrigerants, it is possible to convert the sensed temperature of refrigerant in a saturated liquid state to a corresponding saturation pressure, and to convert pressure of refrigerant in a saturated state to a saturation temperature. The sensed pressure of refrigerant in a saturated liquid state corresponds to a given saturation temperature, which differs from the sensed temperature of liquid refrigerant by a "sub-cool" amount that represents the extent that refrigerant is cooled below saturation temperature.

The "sub-cooled" liquid refrigerant at the condenser coil outlet has a sensed temperature that is below the refrigerant's saturation temperature:

$$T_{SENSED}=T_{SATURATION}-T_{SUBCOOL}),\quad (T_{SUBCOOL}=T_{SATURATION}-T_{SENSED})$$

Likewise, the "sub-cooled" liquid refrigerant should be at a pressure that is below the saturation pressure. Accordingly, a target pressure may be determined by a conversion (using temperature-pressure relationship), of the sensed temperature of the liquid refrigerant line 26 plus a "sub-cool" amount, into a corresponding pressure value, as shown below:

$$T_{SENSED}+T_{SUBCOOL}=T_{SAT};\ \text{convert to pressure}=P_{TARGET} \qquad \text{(Equ. 1)}$$

A plurality of target pressure values representing various ranges (e.g., above, below or within an acceptable refrigerant level) are determined by:

$$T_{SAT\ TARGET\ A}=T_{SENSED}+T_A,\ \text{which converted to pressure}\rightarrow P_A$$

$$T_{SAT\ TARGET\ B}=T_{SENSED}+T_B,\ \text{which converted to pressure}\rightarrow P_B$$

$$T_{SAT\ TARGET\ C}=T_{SENSED}+T_C,\ \text{which converted to pressure}\rightarrow P_C$$

$$T_{SAT\ TARGET\ D}=T_{SENSED}+T_D,\ \text{which converted to pressure}\rightarrow P_D$$

$$T_{SAT\ TARGET\ E}=T_{SENSED}+T_E,\ \text{which converted to pressure}\rightarrow P_E$$

where $T_C$ is a median value=$T_{SUBCOOL}$ (see $T_{SUBCOOL}$ equation).

where $T_A$, $T_B$, $T_C$, $T_D$, and $T_E$ above (as are A, B, C, D, and E in FIG. 4) are stored values.

Figure 4:
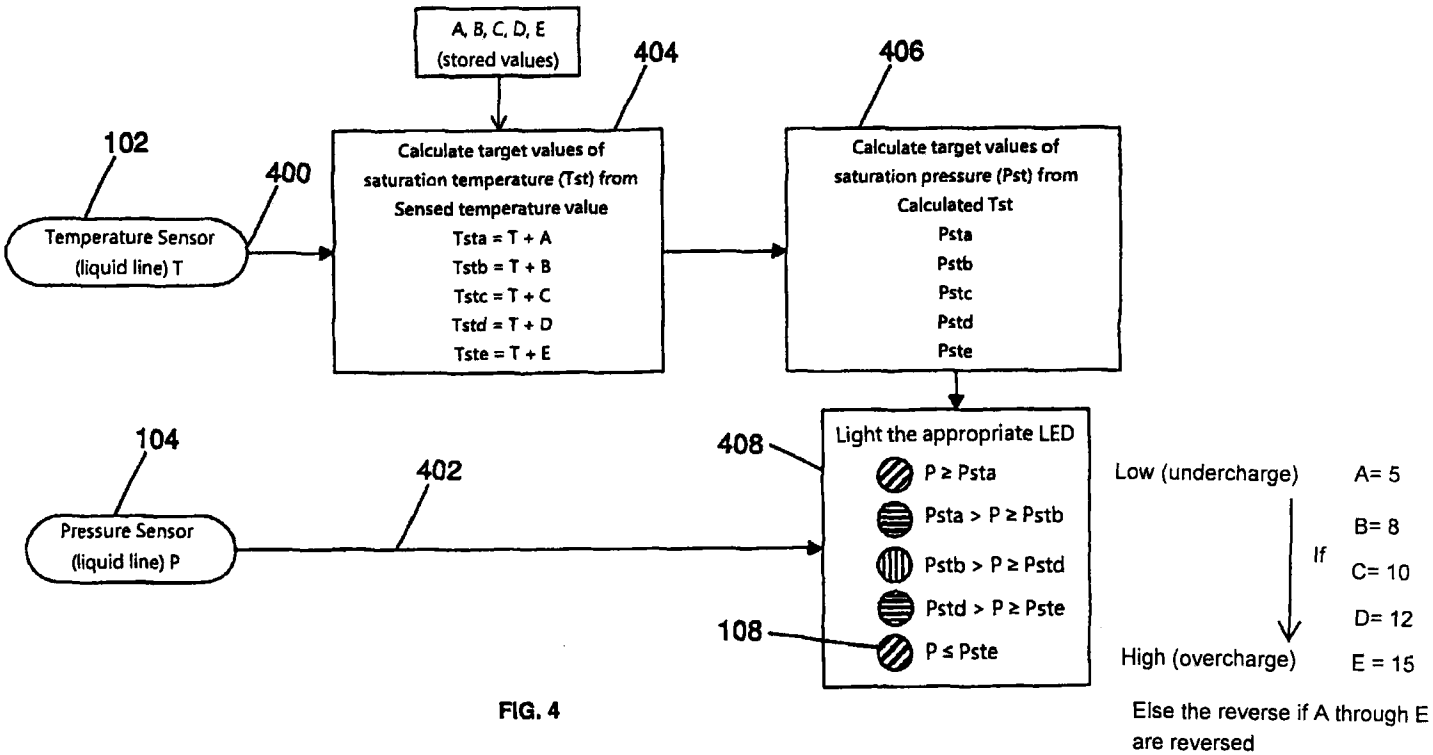
FIG. 4 shows a functional block diagram illustrating the control system and method for monitoring refrigerant charge level, in accordance with the principles of the present disclosure.

The stored values $T_A$, $T_B$, $T_C$, $T_D$, and $T_E$ may differ from system to system, and may also differ according to ambient air temperature. By way of example, typical values may range from 5° F. to 15° F. (e.g., 5° F., 8° F., 10° F., 12° F., and 15° F., etc.). As shown in FIG. 4, the temperatures values A through E are illustrated as 5° F. through 15° F., where A=5° F., B=8° F., C=10° F., D=12° F., and E=15° F. In this example then, the indicators 108 (e.g., 5 LEDs, etc.) from top to bottom indicate undercharge to overcharge. This would be reversed if A through E was 15° F. to 5° F. as then the indicators 108 from top to bottom would indicate overcharge to undercharge. The values of A to E vary as a function of the type of refrigerant, the physical size of the system, and whether the temperature being sensed is the outdoor unit (liquid or vapor line), the indoor unit (liquid or vapor line), or a combination of line temperature (liquid or vapor), and the outdoor temperature.

Thus, the controller 100 may be configured to determine at least one target pressure value by converting a sum of the sensed temperature of the liquid refrigerant line 26 and a sub-cool temperature value into a corresponding pressure value based on a temperature-pressure relationship for the refrigerant. Alternatively, the target pressure value may also be determined by converting the temperature of the liquid refrigerant line 26 to a corresponding pressure value (based on temperature-pressure relationship) and further adding a pressure offset corresponding to a proper amount of subcool, as shown below:

$$P_{SATURATION}=P_{T\ CONVERTED}+P_{SUBCOOL} \qquad \text{(Equ. 2)}$$

where $P_{T\ CONVERTED}$=$T_{SENSED}$ converted to pressure

A plurality of target pressure values representing various ranges (above, below or within an acceptable refrigerant level) may be determined by:

$$T_{SENSED\ CONVERTED\ TO\ PRESSURE}\rightarrow P_{T\ CONVERTED}+P_A=P_{SAT\ TARGET\ A}$$

$$T_{SENSED\ CONVERTED\ TO\ PRESSURE}\rightarrow P_{T\ CONVERTED}+P_B=P_{SAT\ TARGET\ B}$$

$$T_{SENSED\ CONVERTED\ TO\ PRESSURE}\rightarrow P_{T\ CONVERTED}+P_C=P_{SAT\ TARGET\ C}$$

$$T_{SENSED\ CONVERTED\ TO\ PRESSURE}\rightarrow P_{T\ CONVERTED}+P_D=P_{SAT\ TARGET\ D}$$

$$T_{SENSED\ CONVERTED\ TO\ PRESSURE}\rightarrow P_{T\ CONVERTED}+P_E=P_{SAT\ TARGET\ E}$$

where $P_C$ represents an offset corresponding to a proper amount of subcool.

Based on the above, the controller can determine at least one target pressure value by converting sensed temperature into a corresponding pressure value and adding a pressure offset corresponding to a subcool amount. It should be noted that the saturation temperature can be calculated from sensed temperature and pressure of the liquid refrigerant line (for pressures above 150 PSIA) as follows:

$$T_{SAT}=-6.161\times10^{-10}*P_S^4+1.328\times10^{-6}*P_S^3-0.001*P_S^2-0.657*P_S-28.92$$

The "subcool" can be calculated from sensed temperature and pressure of the liquid refrigerant line (for pressures below 150 PSIA) as follows:

$$T_{SAT}=-9.327\times10^{-8}*P_S^4+0.0001*P_S^3-0.012*P_S^2+1.775*P_S.75.417$$

From the above equations for determining at least one target pressure value, the controller 100 may be configured to compare the output of second sensor 104 that is indicative of sensed refrigerant liquid pressure to the at least one target pressure value above to determine if the sensed refrigerant liquid pressure is below a minimum threshold indicative of a low refrigerant charge, and to cause a display to display an indication of low refrigerant charge. More preferably, the controller 100 is configured to convert the temperature of the liquid refrigerant line 26 to a corresponding pressure, and to determine at least two target pressure values from the sum of the corresponding pressure value and at least two pressure offset values. From the at least two target pressure values, the controller 100 is configured to determine if the output of second sensor 104 indicative of pressure is within or outside of an acceptable range defined by the at least two target pressure values, and to responsively display whether the refrigerant level is within or outside of an acceptable level, respectively.

Referring to FIG. 1, the controller 100 may be configured to control a display 106 that comprises one or more indicators for indicating whether the sensed refrigerant level is above, below or within the acceptable range. In this display configuration, the controller 100 is preferably configured to determine a plurality of target pressure values, based on a temperature-pressure conversion of at least the sensed refrigerant liquid temperature of the liquid refrigerant line 26, to determine if the sensed refrigerant liquid pressure is within a range defined by at least two target pressure values representative of a sensed refrigerant level that is above an acceptable range, below an acceptable range, or within an acceptable range. The display 106 is configured to display at least one of one or more indicators for indicating that the sensed refrigerant level is above, below, or within the acceptable range (see indicators 108 in FIG. 3). For example, display 106 may be controlled to illuminate a first "middle" light emitting diode (LED) for indicating an acceptable refrigerant level if the sensed refrigerant liquid pressure is within a range defined by at least two target pressure values representative of a refrigerant level within an acceptable range. Likewise, display 106 can illuminate an "upper" light emitting diode (LED) to indicate that refrigerant is above the acceptable range if the sensed pressure is above a range defined by at least two target pressure values representative of an acceptable range. Display 106 can illuminate a "lower" light emitting diode (LED) to indicate that refrigerant is below the acceptable range if the sensed pressure is below the range defined by at least two target pressure values representative of an acceptable range. Alternatively, the system may include a display that displays one or more indicators representing a relative scale for indicating whether the sensed refrigeration level is above, below or within the acceptable range, as shown in FIG. 3.

Figure 3:
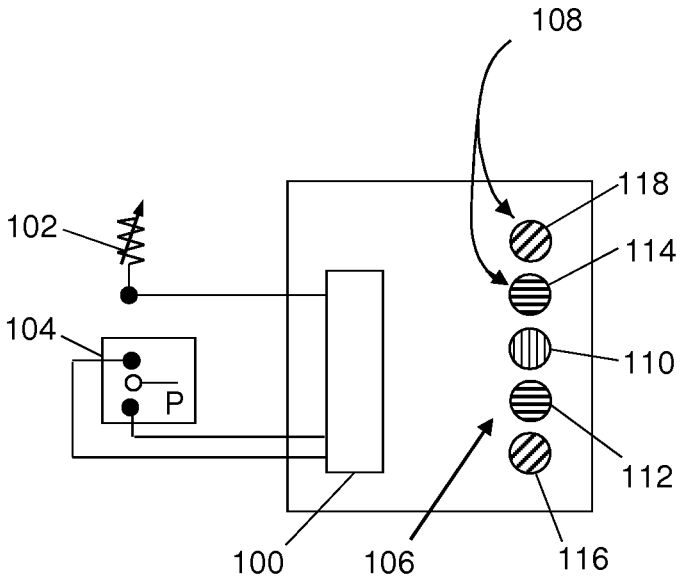
FIG. 3 shows another embodiment of a controller for monitoring refrigerant charge in an air conditioning unit or heat pump.

Referring to FIG. 3, a refrigerant monitoring control is shown that includes a controller 100 in communication with a first sensor 102 providing an output indicative of a temperature of a liquid refrigerant line 26, a second sensor 104 providing an output indicative of pressure in the liquid refrigerant line 26 (in FIG. 1), and a display 106. The display 106 includes a first indicator 110 for indicating that the sensed refrigerant level is within an acceptable range. The display further includes a second indicator 112 for indicating that the sensed refrigerant level is in a range just below the acceptable range, and a third indicator 114 for indicating that the sensed refrigerant level is in a range just above the acceptable range. The controller 100 is further configured to compare the output of second sensor 104 indicative of sensed pressure to at least one target pressure value representative of a minimum threshold, to determine if the sensed pressure is below a minimum threshold indicative of a low refrigerant charge level. The display 106 is configured to display an indication of a low refrigerant charge level at 116. The controller 100 is further configured to compare the output of second sensor 104 indicative of sensed pressure to at least one target pressure value representative of a maximum threshold, to determine if the sensed pressure exceeds a threshold indicative of a high refrigerant charge level. The display 106 is correspondingly configured to display an indication of a high refrigerant charge level at 118. Alternatively, instead of the above described LED display configurations, the display 106 may comprise a segmented character display for displaying indicators such as "Hi," "Lo" and "OK," or a dot-matrix type display.

In the embodiment shown in FIG. 3, the controller 100 may include a wired connection with a "Y" terminal of a thermostat (e.g., thermostat 30 shown in FIG. 1), so as to detect a 24 volt signal for activating the air conditioner or heat pump 20. Preferably, the controller 100 is configured to power-up upon receiving an activation signal from a thermostat, or may be powered by a 24 volt signal from a thermostat, such that the controller 100 is operable to monitor the refrigerant charge level only upon activation of the air conditioner or heat pump 20. The controller 100 is configured to interpret the output signal of first sensor 102, which may be a voltage output for example, to determine a sensed temperature of a liquid refrigerant line 26 as shown in FIG. 1. The controller 100 is also configured to interpret the output signal of second sensor 104, which may be a voltage output for example, to determine a sensed pressure in a liquid refrigerant line 26 as shown in FIG. 1. The controller 100 may be configured to include a calibration mode, where at the end of calibration all the LED indicators will blink. In the case of a failure of first sensor 102 or second sensor 104, the indicators may be illuminated to indicate a fault. After at least about 30 seconds following activation, the controller 100 is configured to determine at least one target pressure value (by converting at least the sensed temperature to a corresponding pressure value), and to compare the sensed pressure to the at least one target value to thereby determine whether the refrigerant charge is within or outside of an acceptable range, as explained herein.

According to another aspect of the present disclosure, various embodiments of a method for monitoring refrigerant charge are provided. The controller described in the various exemplary embodiments is preferably programmed to control operation as shown in FIG. 4. The functional block diagram in FIG. 4 illustrates the operational control of one or more embodiments, and provides a method for monitoring refrigerant charge level in an air conditioner or heat pump 20 shown in FIG. 1. The method comprises the steps of a first sensor 102 providing a first output (at 400) indicative of a sensed temperature of a liquid refrigerant line 26 within or extending from an outlet of a condenser coil 24 of an air conditioner or heat pump 20 (as shown in FIG. 1), and a second sensor 104 providing a second output (at 402) indicative of a sensed pressure in the liquid refrigerant line. At 404 and 406, the method determines or calculates at least one target pressure value (or a plurality of target pressure values) from the output indicative of the sensed temperature. The method for monitoring refrigerant charge further includes comparing the sensed pressure from second sensor 104 to the target pressure value(s), and determining at 408 if the level of refrigerant charge is at, above, or below an acceptable level based on a comparison of the output indicative of sensed pressure to the at least one target pressure value. The method further includes displaying an indication (via indicators 108) of whether the level of refrigerant charge is at, above, or below an acceptable level.

In one preferred embodiment of the above method, the step of determining at least one target pressure value comprises converting at least the sensed temperature of the liquid refrigerant line into a corresponding pressure value based on a temperature-pressure relationship for the refrigerant. More preferably, the step of determining at least one target pressure value comprises converting a sum of the sensed temperature of the liquid refrigerant line 26 (in FIG. 1) and a sub-cool temperature value into a corresponding pressure value based on a temperature-pressure relationship for the refrigerant. With regard to the system illustrated in FIG. 3, the above described step of determining at least one target pressure value comprises determining a plurality of target pressure values based on a temperature-pressure conversion of at least the sensed temperature of the liquid refrigerant line 26, and determining if the level of refrigerant charge is at, above, or below an acceptable level. The step of determining if the level of refrigerant charge is at, above, or below an acceptable level comprises determining if the sensed pressure is within a range defined by at least two target pressure values representative of a sensed refrigerant level that is above, below or within an acceptable range, and displaying an indication comprises displaying at least one of one or more indicators for indicating that the sensed refrigerant level is above, below, or within the acceptable range.

While the display described in above embodiment pertains to an isolated control for monitoring refrigerant level, or a unitary control 124, or a defrost control, other embodiments may incorporate the above described monitoring means. For example, in one alternate embodiment, the controller 100 described above may be configured for wireless communication with a thermostat (such as thermostat 30 shown in FIG. 1) The controller 100 is in communication with the first sensor 102 that provides an output indicative of a sensed refrigerant liquid temperature of a liquid refrigerant line 26 within or extending from an outlet of a condenser coil 24 of an air conditioner or heat pump 20, and also a second sensor 104 that provides an output indicative of a sensed refrigerant liquid pressure in the liquid refrigerant line 26. As in the above described embodiments, the controller 100 is configured to determine at least one target pressure value from the output indicative of the sensed refrigerant liquid temperature of the liquid refrigerant line 26, and to determine if the level of refrigerant charge is at, above, or below an acceptable level based on a comparison of the output indicative of sensed refrigerant liquid pressure to the at least one target pressure value. The controller 100 is configured to wirelessly communicate to the thermostat 30 information related to the level of refrigerant charge, e.g., a level at, above, or below an acceptable level. The thermostat 30 is configured to responsively display on a display thereon an indication of whether the level of refrigerant charge is at, above, or below an acceptable level. As indicated above, such a display may be through an LED display, or a simple segmented character display for displaying indicators such as "Hi," "Lo" and "OK," or a dot-matrix type display.

Alternatively, the controller 100 may be incorporated into a thermostat (e.g., thermostat 30 shown in FIG. 1), which is in wireless communication with at least a first sensor 102 that provides an output indicative of a sensed refrigerant liquid temperature of a liquid refrigerant line 26 that is within or extending from an outlet of a condenser coil 24 of an air conditioner or heat pump 20. The thermostat 30 is also in wireless communication with a second sensor 104 that provides an output indicative of a sensed refrigerant liquid pressure in the liquid refrigerant line 26. The controller 100 described in the above embodiments is included in the thermostat 30 and is configured to determine at least one target pressure value from the output indicative of the sensed refrigerant liquid temperature of the liquid refrigerant line 26. The thermostat 30 is further configured to determine if the level of refrigerant charge is at, above, or below an acceptable level based on a comparison of the output indicative of sensed refrigerant liquid pressure to the at least one target pressure value, and to responsively display on a display 106 thereon an indication of whether the level of refrigerant charge is at, above, or below an acceptable level. Accordingly, it should be understood that the above systems and methods for monitoring refrigerant charge level may be employed in a number of configurations in different control devices.

Accordingly, aspects of the present disclosure generally relate to the ability to detect a low or high refrigerant level in a vapor compression air conditioning apparatus, such as a central home air conditioner. Aspects also generally relate to the ability to generate a display of the degree of sub-cooling, e.g., in degrees Fahrenheit. For example, disclosed here are exemplary embodiments of methods that include sensing the temperature of the liquid line, sensing the pressure of the liquid line, and using these sensed temperature and pressure values to determine the degree of sub-cooling and the status of the refrigerant level in the system. In exemplary embodiments, the method may also include adding the sensed temperature to a range of stored temperature values to generate a table of temperature values. Each generated sum for a temperature is converted to an equivalent saturation pressure, to generate a range or table of saturation pressures, derived from the list of temperatures. Then, each of these derived pressure values is compared to the value for the liquid line pressure. The logical comparison of these values to the directly sensed liquid line pressure determines the state of the refrigerant charge in the system. A signal may then be outputs to a display device. For example, a signal may be output to a display device having 5 LEDs such that one of the 5 LEDs is illuminated to indicate to a user the state of refrigerant charge in the system. In addition, this exemplary method also uses the temperature of the liquid line and a calculated saturation temperature from the sensed liquid line pressure to determine a value for the degree of sub-cooling in the system, and then outputs that value to a human readable display, such as a segmented LED.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A refrigerant charge monitoring system comprising:

a first sensor operable to provide an output indicative of a sensed refrigerant liquid temperature of a liquid refrigerant line that is within or extending from an outlet of a condenser coil of an air conditioner or heat pump unit;

a second sensor operable to provide an output indicative of a sensed refrigerant liquid pressure of the liquid refrigerant line; and a controller configured to determine at least one target pressure value from the output indicative of the sensed refrigerant liquid temperature, the controller being configured to determine if the level of refrigerant charge is at, above, or below an acceptable level based on a comparison of the output indicative of sensed refrigerant liquid pressure to the at least one target pressure value;

wherein the controller is a processor of a thermostat that is configured to wirelessly receive the output indicative of sensed pressure and the output indicative of a sensed temperature of a liquid refrigerant line.

2. The system of claim 1, wherein:

the first sensor is operable to sense the temperature of the liquid refrigerant line at the outlet of the condenser coil; and the second sensor is operable to sense the pressure of the liquid refrigerant line at the outlet of the condenser coil.

3. The system of claim 1, further comprising a display that displays an indication of whether the level of refrigerant charge is at, above, or below an acceptable level.

4. The system of claim 1, wherein the controller is configured to determine at least one target pressure value by converting at least the sensed refrigerant liquid temperature of the liquid refrigerant line into a corresponding pressure value based on a temperature-pressure relationship for the refrigerant.

5. The system of claim 1, wherein the controller is configured to compare the output indicative of sensed refrigerant liquid pressure to at least one target pressure value to determine if the sensed refrigerant liquid pressure is below a minimum threshold indicative of a low refrigerant charge level.

6. The system of claim 1, wherein the controller is configured to compare the output indicative of sensed refrigerant liquid pressure to at least one target pressure value to determine if the sensed refrigerant liquid pressure exceeds a threshold indicative of a high refrigerant charge level.

7. The system of claim 1, wherein the controller is configured to determine a difference between the output indicative of sensed refrigerant liquid pressure and at least one target pressure value, and to display on a display device an indication of a low refrigerant charge level where the difference exceeds a threshold indicative of a low refrigerant charge level.

8. The system of claim 1, wherein the controller is a processor of a control for activating at least a compressor of an air conditioner or heat pump.

9. The system of claim 1, wherein the controller is a communication device for communicating information indicating that the refrigerant charge is at, above, or below an acceptable level based on a comparison of the output indicative of sensed pressure to the at least one target pressure value.

10. The system of claim 1, further comprising a display of the thermostat configured to display an indication of whether the level of refrigerant charge is at, above, or below an acceptable level.

11. A refrigerant charge monitoring system comprising:

a first sensor operable to provide an output indicative of a sensed refrigerant liquid temperature of a liquid refrigerant line that is within or extending from an outlet of a condenser coil of an air conditioner or heat pump unit;

a second sensor operable to provide an output indicative of a sensed refrigerant liquid pressure of the liquid refrigerant line; and a controller configured to determine at least one target pressure value from the output indicative of the sensed refrigerant liquid temperature, the controller being configured to determine if the level of refrigerant charge is at, above, or below an acceptable level based on a comparison of the output indicative of sensed refrigerant liquid pressure to the at least one target pressure value;

wherein the controller is configured to determine if the sensed refrigerant liquid pressure is within a range defined by at least two target pressure values representative of a sensed refrigerant level that is above, below, or within an acceptable range.

12. The system of claim 11, further comprising a display configured to display at least one of one or more indicators for indicating that the sensed refrigerant level is above, below, or within the acceptable range, and wherein the display displays one or more indicators representing a relative scale for indicating whether the sensed refrigeration level is above, below or within the acceptable range.

13. The system of claim 11, wherein the controller is a processor of a thermostat that is configured to wirelessly receive the output indicative of sensed pressure and the output indicative of a sensed temperature of a liquid refrigerant line.

14. A refrigerant charge monitoring system comprising:

a first sensor operable to provide an output indicative of a sensed refrigerant liquid temperature of a liquid refrigerant line that is within or extending from an outlet of a condenser coil of an air conditioner or heat pump unit;

a second sensor operable to provide an output indicative of a sensed refrigerant liquid pressure of the liquid refrigerant line; and a controller configured to determine at least one target pressure value from the output indicative of the sensed refrigerant liquid temperature, the controller being configured to determine if the level of refrigerant charge is at, above, or below an acceptable level based on a comparison of the output indicative of sensed refrigerant liquid pressure to the at least one target pressure value;

wherein the controller is configured to determine at least two target pressure values and to compare the output indicative of sensed refrigerant liquid pressure to the plurality of target pressure values to determine if the sensed refrigerant liquid pressure is between at least two target pressure values that are indicative of an acceptable range for a sensed refrigerant charge level.

15. A method for monitoring refrigerant charge, the method comprising:

sensing and providing a first output indicative of a sensed refrigerant liquid temperature of a liquid refrigerant line that is within or extending from an outlet of a condenser coil of an air conditioner or heat pump unit;

sensing and providing a second output indicative of a sensed refrigerant liquid pressure of the liquid refrigerant line;

determining at least one target pressure value from the output indicative of the sensed refrigerant liquid temperature of the liquid refrigerant line; and determining if the level of refrigerant charge is at, above, or below an acceptable level based on a comparison of the output indicative of sensed refrigerant liquid pressure to the at least one target pressure value;

wherein:

determining if the level of refrigerant charge is at, above, or below an acceptable level comprises determining if the sensed refrigerant liquid pressure is within an acceptable range defined by at least two target pressure values; and the method further comprises displaying at least one of one or more indicators for indicating whether the level of refrigerant charge is above, below, or within the acceptable range.

16. The method of claim 15, wherein:

sensing and providing a first output indicative of a sensed refrigerant liquid temperature of a liquid refrigerant line comprises sensing the temperature of the liquid refrigerant line at the outlet of the condenser coil; and sensing and providing a second output indicative of a sensed refrigerant liquid pressure of the liquid refrigerant line comprises sensing the pressure of the liquid refrigerant line at the outlet of the condenser coil.

17. The method of claim 15, wherein determining at least one target pressure value comprises converting at least the sensed refrigerant liquid temperature of the liquid refrigerant line into a corresponding pressure value based on a temperature-pressure relationship for the refrigerant.

18. The method of claim 15, wherein:

determining if the level of refrigerant charge is at, above, or below an acceptable level comprises comparing the output indicative of sensed refrigerant liquid pressure to at least one target pressure value to determine if the sensed refrigerant liquid pressure is below a minimum threshold indicative of a low refrigerant charge level; and the method further includes displaying an indication of a low refrigerant charge level.

19. The method of claim 15, wherein:

determining if the level of refrigerant charge is at, above, or below an acceptable level comprises comparing the output indicative of sensed refrigerant liquid pressure to at least one target pressure value to determine if the sensed refrigerant liquid pressure exceeds a threshold indicative of a high refrigerant charge level; and the method further includes displaying an indication of a high refrigerant charge level.

* * * * *